US006880442B2

(12) United States Patent
Duginske

(10) Patent No.: US 6,880,442 B2
(45) Date of Patent: Apr. 19, 2005

(54) WOODWORKING MACHINERY JIG AND FIXTURE SYSTEM

(75) Inventor: Mark A. Duginske, Merrill, WI (US)

(73) Assignee: Mark Duginske LLC, Merrill, WI (US)

( * ) Notice: Subject to any disclaimer, the term of this patent is extended or adjusted under 35 U.S.C. 154(b) by 112 days.

(21) Appl. No.: 10/237,851

(22) Filed: Sep. 6, 2002

(65) Prior Publication Data

US 2003/0056631 A1 Mar. 27, 2003

Related U.S. Application Data

(60) Provisional application No. 60/317,994, filed on Sep. 7, 2001.

(51) Int. Cl.[7] ..... B27B 27/00; B27B 31/00

(52) U.S. Cl. ..... 83/468.7; 83/468.3; 269/303; 144/253.1

(58) Field of Search ..... 83/468.7, 468, 83/467.1, 431, 435, 435.11, 435.14–435.16, 477.2, 714, 715, 468.3; 144/253.1, 251.1, 253.5, 251.2; 33/832, 497, 430, 471; 269/303, 304, 315, 306

(56) References Cited

U.S. PATENT DOCUMENTS 1,994,422 A * 3/1935 Sasek ..... 269/309
2,260,708 A * 10/1941 French ..... 269/160
2,285,897 A * 6/1942 Campbell ..... 83/415
4,693,158 A * 9/1987 Price ..... 83/468
4,747,330 A * 5/1988 Carithers, Jr. ..... 83/468.7
4,871,156 A * 10/1989 Kozyrski et al. ..... 269/303
5,018,562 A * 5/1991 Adams ..... 144/253.1
5,337,641 A 8/1994 Duginske
5,443,554 A * 8/1995 Robert ..... 83/468.7
5,490,665 A * 2/1996 Thiele et al. ..... 269/303
5,608,970 A * 3/1997 Owen ..... 29/897.31
5,617,909 A * 4/1997 Duginske ..... 144/253.1
5,695,178 A * 12/1997 Lenzkes ..... 269/99
5,716,045 A * 2/1998 Taylor ..... 269/303
5,768,966 A * 6/1998 Duginske ..... 83/468.7
6,557,601 B1 * 5/2003 Taylor ..... 144/253.1

OTHER PUBLICATIONS

Laguna Tools; Webpage at www.lagunatools.com; LM410 Combination Machine; Printed Jan. 6, 2003.
Martin Woodworking Machines Corp.; Webpage at www.martin–usa.com; Sliding Table Saw T 73, including T 73 Basic, T 73 Classic, and T 73 CNC; Printed Jan. 6, 2003.

* cited by examiner

*Primary Examiner*—Allan N. Shoap
*Assistant Examiner*—Ghassem Alie
(74) *Attorney, Agent, or Firm*—Quarles & Brady LLP

(57) ABSTRACT

A woodworking machinery jig and fixture system includes a track which is or may be attached to a fence, a convex-concave curved flip stop and a base which mounts the stop to the track. The stop has a projecting portion which penetrates the plane of the fence so the stop isn't lifted by the point of a mitered board. The stop also has a lower convex surface which faces the work support surface and curves up at both ends. The top leg of the stop is concave toward the fence to allow clearance for a zero-clearance board and make the stop adaptable to different track and fence configurations. The base has opposite sides of different widths bordered by steps on one side and a ramp on the other side so the base can be used in a large range of T-track slot widths. The arm mounting hole of the base is offset from the base mounting so as to provide an offset to accommodate a ¾" zero clearance board by turning the base a half turn relative to the slot. A two slot track is provided in which one of the slots can mount a sliding measurement tape or a base, and the other slot can also mount a base. In another track, a sidewall flange is provided which can be filed to accurately fit into a miter gauge slot of a cutting tool table.

12 Claims, 9 Drawing Sheets

Fig. 2
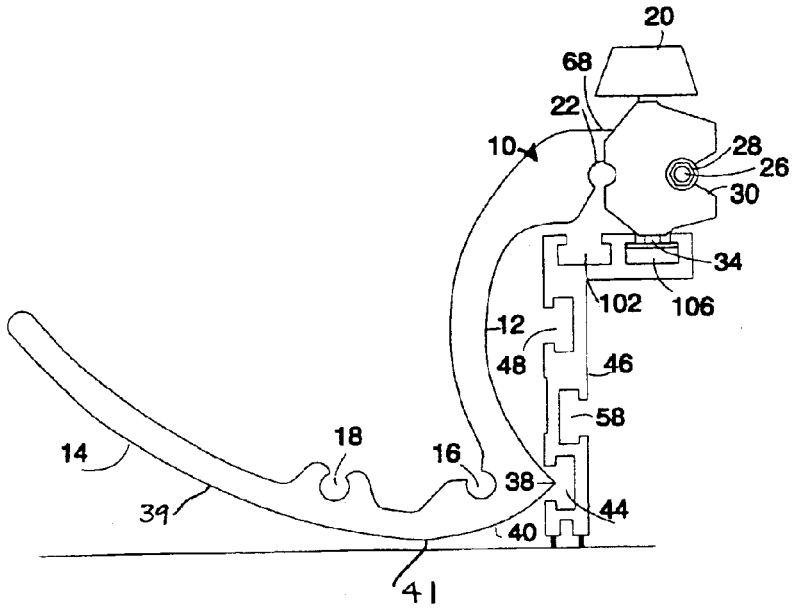
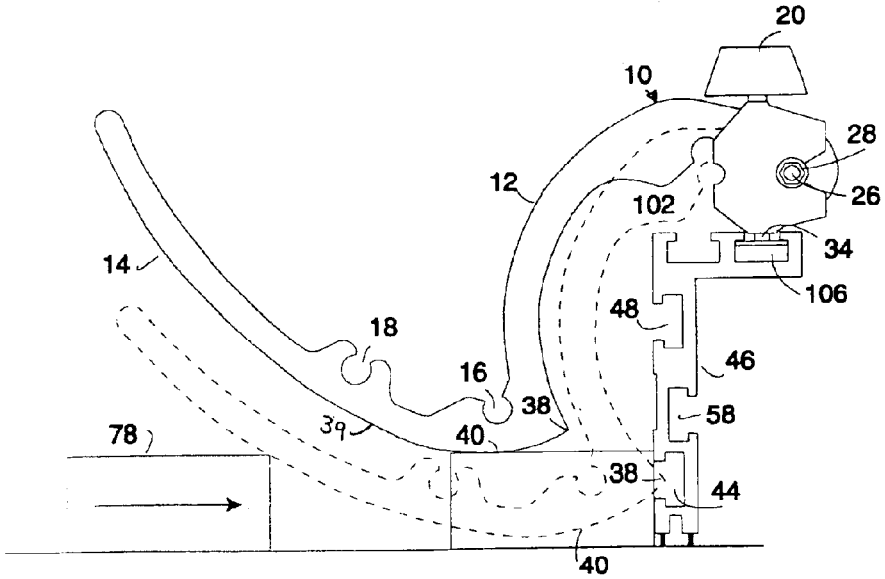
Fig. 3

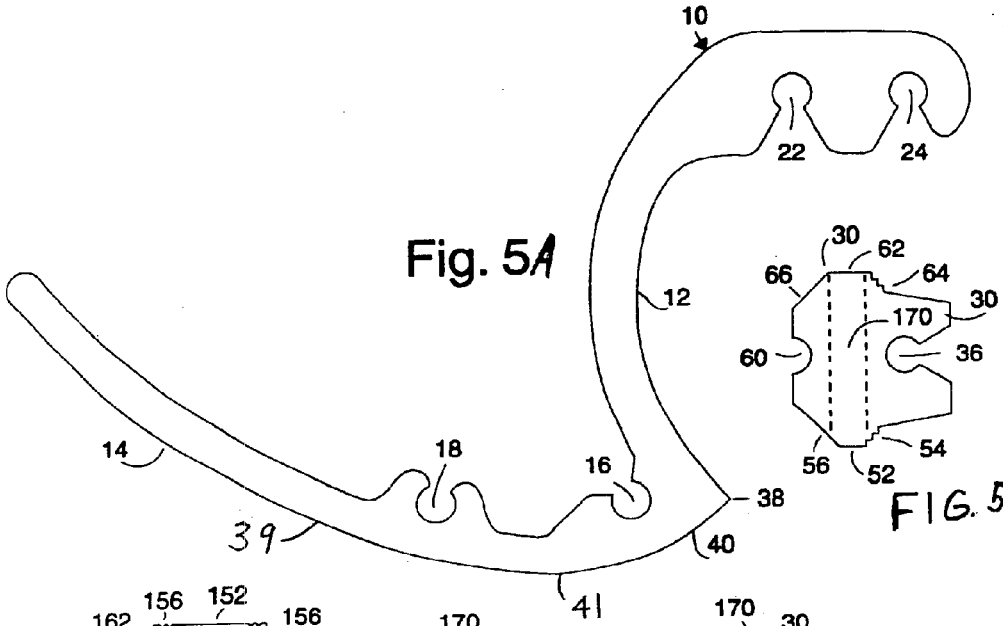
Fig. 5A
FIG. 5B
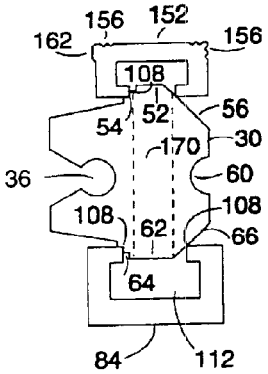
Fig. 6
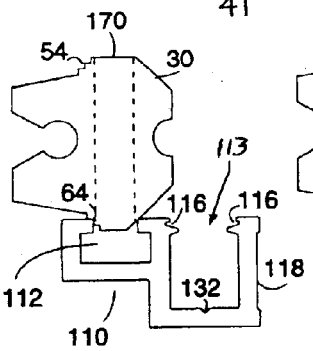
Fig. 7
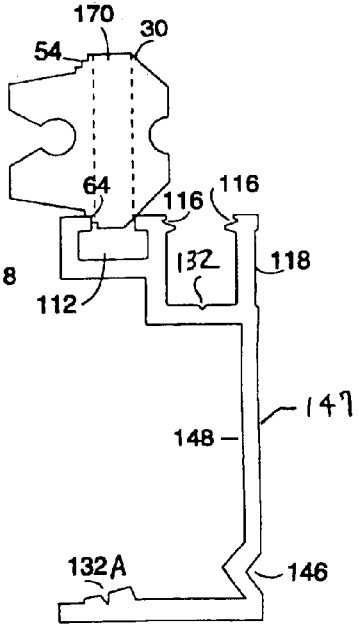
Fig. 8

WOODWORKING MACHINERY JIG AND FIXTURE SYSTEM

CROSS-REFERENCE TO RELATED APPLICATION

This claims the benefit of U.S. Provisional Patent Application No. 60/317,994 filed Sep. 7, 2001.

STATEMENT CONCERNING FEDERALLY SPONSORED RESEARCH OR DEVELOPMENT

Not applicable.

FIELD OF THE INVENTION

This invention relates to shop made jigs and fixtures for positioning, aligning, guiding and/or holding a workpiece on metalworking or woodworking machines during a cutting or shaping operation.

BACKGROUND OF THE INVENTION

U.S. Pat. Nos. 5,337,641, 5,617,909 and 5,768,966, which are hereby incorporated by reference, disclose improved jigs and fixtures for aligning, guiding and or holding a workpiece as it is worked, for example as it is cut, drilled or routed. While the jigs and fixtures disclosed in U.S. Pat. Nos. 5,337,641, 5,617,909 and 5,768,966 represent a significant advance in the art, room still exists for improvement, particularly in the following respects.

One problem is with the fit of the stop in the T-slot of typical jig and fixture systems. It is typical that the stops available do not lock securely in the T-slot. There is typically a slight variation in the extrusions which compromises the fit. In addition, there is no stop base that fits a variety of different width T-slots. Thus, there is no stop that works with the different extrusions that are on the market.

U.S. Pat. No. 5,337,641 teaches that the stop can be bolted in the down position, but this requires threading a bolt through the stop into the base, which is tedious. This is necessary, for example, when cutting a mitered board with the pointed side against the fence. Typical stops available are not designed to allow cutting a miter with either the point in or the point out with out any manipulation.

At times, it is necessary to place a board under the stop, i.e., between the table surface and the stop, for example, when using a moveable backer board underneath a workpiece being drilled on a drill press table. This can interfere with the operation of typical available stops. In addition, typical stops require that they be manually picked up to the standby position to place the board under them.

It is also sometimes useful to place a moveable zero clearance board behind the stop, i.e., between the stop and the fence, on a radial or miter saw. This pushes the stop forward or prevents it from swinging all of the way down in typical stops, which interferes with the use of the stop.

Other problems are accommodating different fence heights, how measurements are made using measuring tapes provided on the track, and track mounting to boards or miter guide slots.

SUMMARY OF THE INVENTION

The invention provides an improved woodworking machinery jig and fixture system which has a woodworking support which defines a working plane and a stop for guiding a workpiece supported by the woodworking support to position the workpiece relative to a woodworking tool.

In one aspect, the stop has a projecting portion on a rear face facing the woodworking support and the woodworking support has a recess which opens to the working plane. The recess is positioned so as to receive the projecting portion in a work position of the stop so that the projecting portion penetrates the working plane of the woodworking support in the work position. Thereby, the point of a mitered board does not lift the stop when the point is against the woodworking support.

In another aspect, the stop is pivotable about a longitudinal axis and is generally L-shaped, having a top leg with a rear surface that faces the woodworking support and that is concave toward the woodworking support, and a bottom leg connected to a lower end of the top leg, the bottom leg extending from the top leg away from the woodworking support. The concavity of the top leg provides clearance with a zero clearance board and makes the stop adaptable to a wide variety of different systems and different fence heights.

In another aspect, the bottom leg of the stop has a lower surface which is convex toward a work surface on which a workpiece can be supported. The convexity of the lower surface allows the stop to be self-lifting. The lower surface has a point of inflection between its ends, which is the closest point to the work support surface, so the lower surface curves upwardly from the point of inflection toward both ends. This enables the stop to be used with a backer board and still function as a stop for a workpiece on top of the backer board. It also permits the stop to be used with varying support heights.

In another aspect, the mounting hole which extends through the base that connects the stop to the track extends through opposed longitudinal surfaces of the base, one longitudinal surface on each side of the base. Each of the longitudinal surfaces may be received in a slot of a track and the surfaces are different in width to fit different width slots.

In this aspect, a surface of the base adjacent at least one of the longitudinal surfaces includes longitudinally extending steps leading to the surface. Thereby, the steps allow the surface to fit into different width slots, with different width slots seating on different steps.

In an especially preferred feature of this aspect, the base includes a longitudinally extending ramped surface angling outwardly from the at least one longitudinal surface on a side of the longitudinal surface which is opposite from the steps. The ramp cams against the edge of the T-track slot to push the opposite edge of the surface, or of one of the steps, against the opposite edge of the slot, to provide a snug fit of the base in the slot with the axis of the base mounting hole generally perpendicular to the T-slot.

In another aspect, the base can be turned about the mounting hole axis to offset the arm hole axis by ¾", which is useful when using ¾" zero-clearance boards.

In another aspect, the track has a second slot in which a measurement tape can be slidably mounted. In this aspect, the track is preferably made ¾" high to be compatible with ¾" boards, or can be made with an integral foot which supports the track at a normal fence height.

In another aspect, a track is provided having a flange which extends laterally from the side and is of a height which is less than the height of the side. The flange can be filed down to provide a close fit of the track in a miter gauge slot of a cutting tool table. The flange is preferably defined adjacent to a corner between the side it is on and the bottom. Grooves can be provided in the side or bottom surfaces of this track so the track can be glued into a groove or dado.

These and other aspects and features of the invention will be apparent from the detailed description and drawings.

BRIEF DESCRIPTION OF THE DRAWINGS

FIG. 2 is an end view of the track of U.S. Pat. No. 5,768,966 with the curved flip stop assembly positioned on it.

FIG. 3 is an end view similar to FIG. 2 but illustrating how as the workpiece is moved forward, the curved flip stop arm is elevated to the standby position by camming on the workpiece.

FIG. 5A is an end view of the curved flip stop arm for the stop assembly.

FIG. 5B is a detail end view of the base for the stop assembly.

FIG. 6 is an end view of the stop base shown with a small T track contacting the narrow side of the base. A larger T track extrusion is shown on the wide side of the base.

FIG. 7 is an end view of the stop base shown with a two slot T track contacting the narrow side of the base.

FIG. 8 is an end view of the stop base shown with a modified two slot T track contacting the narrow side of the base.

DETAILED DESCRIPTION OF THE PREFERRED EMBODIMENT

Figure 1:
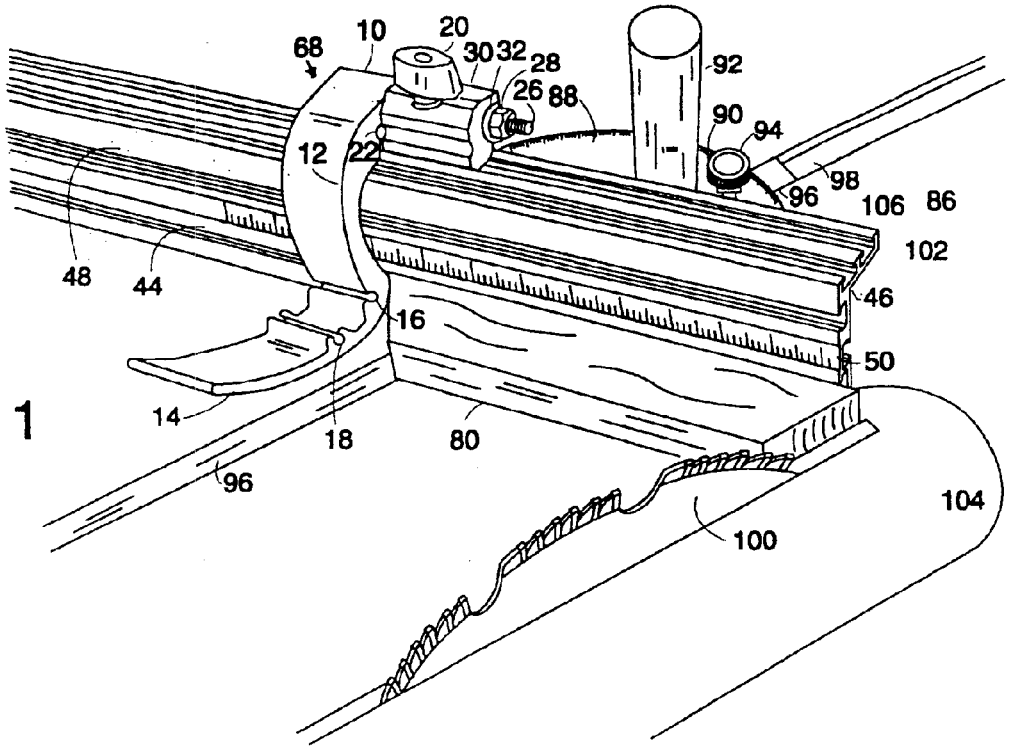
FIG. 1 is a perspective view of a curved flip stop assembly of the invention positioned on the track of U.S. Pat. No. 5,768,966 as it is used on a tablesaw.

FIG. 1 illustrates a curved flip stop assembly of the invention 68 mounted to the fence track 46, which is one type of woodworking support, and miter guide 88 of U.S. Pat. No. 5,768,966. A miter gauge 88 which is attached to a miter gauge bar 96 fits into the table saw miter slot 98 and is used to control the workpiece as it is moved past the saw blade 100. A flip stop assembly 68 is shown on the L shaped track 46 which includes a curved L shaped flip stop arm 10 which is attached to a base 30 by a ¼" bolt 26 and a lock nut 28. The flip stop assembly 68 is used to crosscut boards to length by measuring the distance between the end of the board 80 and the saw blade 100. The end of the board is pressed against the stop arm 10 while the other end is cut with the blade 100. When the flip stop assembly 68 is not in use the flip stop arm 10 is flipped out of the way. The flip stop assembly 68 is slideable along the length of a track by loosening knob 20 to loosen the head of the bolt 34 which slides in one of the T-shaped slots 106 of the track 46. The exact distance between the saw blade 100 and the flip stop assembly 68 can be measured with the stick-on-ruler 50 attached to the track extrusion 46.

In FIG. 1 the miter gauge head 88 is secured to the miter gauge bar 96 by the miter gauge lock knob 94 and the miter gauge handle 92 at a 30 degree angle. This is the angle used to cut a frame with six sides. The point 38 at the back of the flip arm 10 is a projecting portion of the stop 10 that extends into the bottom T-slot 44 of the track 46 so as to penetrate the working plane of the track and prevent the pointed workpiece 80 from lifting up the flip stop arm 10. This is an improvement over the flip stop arm of U.S. Pat. No. 5,337,641 which required the use of a bolt to prevent a pointed workpiece from lifting the flip stop arm.

Figure 4:
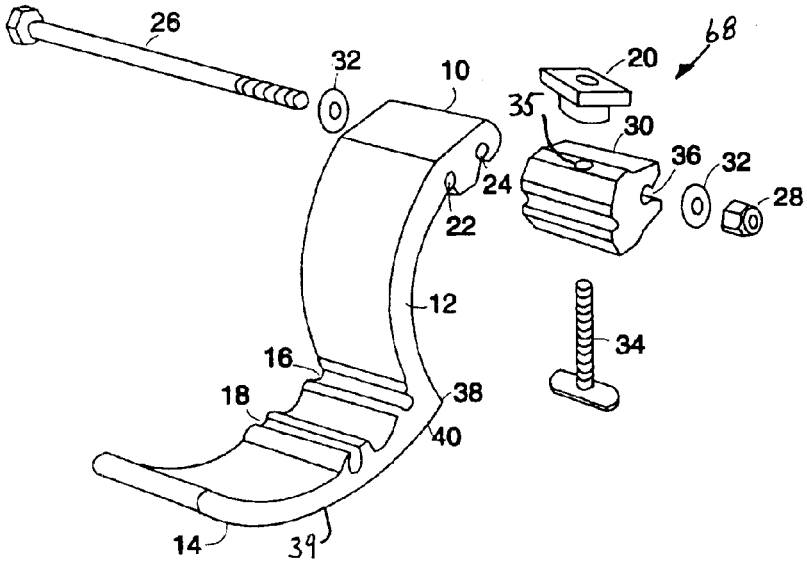
FIG. 4 is an exploded perspective view of the curved flip stop assembly.

FIG. 2 is the end view of FIG. 1 showing the flip stop assembly 68 on the L shaped track 46 which includes a curved L-shaped flip stop arm 10 which is attached to a base 30 by a ¼" bolt 26 and a lock nut 28. The flip stop assembly 68 is secured to the track 46 by threaded knob 20 and the bolt 34 has a head (See FIG. 4) which slides in one of the T-shaped slots 106.

FIG. 3 is similar to FIG. 2, showing the flip stop assembly 68 on the L-shaped track 46 which includes a curved L-shaped flip stop arm 10 which is attached to a base 30 by a ¼" bolt 26 and a lock nut 28. The flip arm 10 differs from the flip arm described in U.S. Pat. No. 5,337,641 because the legs 12 and 14 are curved. The bottom curve 14 allows the stop to be lifted to a standby position by pushing a workpiece under it, without having to manually lift it out of the way.

The bottom leg has two curved parts, the long part of the arm has a gentle curve 14. At the bottom side of the rear or fence end of the bottom leg 14, there is another flatter curve 40 of a different curvature than the bottom side of the foot forward of the heel 40. When the workpiece 78 is shoved against the flip stop arm 10, it contacts the bottom side of the curved foot 14. As the workpiece 78 is moved toward the fence 46, it slides under the curved foot 14, first contacting the forward portion 39 of it. As the workpiece is moved further toward the fence, this elevates the stop 10 lifting it out of the way. By the time the workpiece 78 contacts the fence 46, the flatter bottom curve 40, or heel rests on top of the workpiece.

This mechanism is useful on a miter or radial arm saw where a number of stop assemblies 68 would be used to efficiently cut pieces to length. To engage the stop mechanism, after the workpiece is moved under the desired stop assembly and all of the stop assemblies between the desired one and the cutting tool, the workpiece is moved laterally (parallel to the fence) until the stop arm bottom 14 and 40 no longer rests on top of it, which causes the stop 10 to fall. Then, the workpiece is moved laterally against the side surface of the desired stop arm 10, which acts as a stop to position the workpiece relative to the cutting tool.

FIGS. 5A and 5B are an end views of the respective stop and base extrusions for the stop assembly 68. The stop arm 10 is L shaped with two curved legs 12 and 14. The top leg 12 has a surface facing the fence which is curved away from the fence 46 so that it is concave toward the fence. The bottom leg 14 has a bottom convex surface facing the table which has a curved surface 39 of one curvature toward its free or front end and a curved surface 40 of a different curvature on its rear or fence end. The relationship of the surfaces 39 and 40 is such that the intersection 41 (FIGS. 2 and 5A) of the surfaces 39 and 40 is close to the table top when the arm 10 is in its normal work position, as shown in FIG. 2. Since the surface 40 is oriented upwardly from the end of the surface 39 in this position of the arm, when a workpiece is slid under the arm, past the junction 41 (FIG. 5A) between the surfaces 39 and 40, the arm 10 is lifted less than what it would have been had the surface 39 simply continued, so the arm is maintained relatively closer to the fence than would otherwise have been the case. This provides greater usefulness as a stop, particularly for smaller workpieces, and allows the stop to be used with a greater range of fence heights.

The convex bottom surface and the concave rear surface of the stop 10 meet at a point or junction 38 on the rear side of the stop 10. Two ¼" hole openings 16 and 18 in the bottom leg 14 permit the mounting of accessories such as a larger wood fence or a microadjusting bolt. Two ¼" hole openings 22 and 24 at the top of the top leg 12 have the same spacing as the corresponding holes in the flip stop arm of U.S. Pat. No. 5,337,641. This means that the stop arm 10 can be used with the base and microadjuster from U.S. Pat. No. 5,337,641. The slotted hole openings 16, 18, 22, and 24 decrease the cost of an extrusion die versus having a solid hole (without an open side) in the extrusion.

The base 30 (FIG. 5B) is an improvement over the base of U.S. Pat. No. 5,337,641. The hole opening 36 accepts the bolt 26 which attaches the flip arm 10 to the base 30. The half circle indentation 60 corresponds to the threaded hole in the base of U.S. Pat. No. 5,337,641 so the stop can be locked in the down position. The base 30 has two protrusions 52 and 62 on each side which extend longitudinally along the sides of the base which fit into the T-slot of the tracks to help guide the base and prevent it from rotating relative to the track. The small protrusion of the base of U.S. Pat. No. 5,337,641 does not always fit well in the track because extrusions may vary in size. The lack of a tight fit allows the stop assembly of U.S. Pat. No. 5,337,641 to rotate slightly, compromising accuracy. The protrusions 52 and 62 are designed to lock tightly in a T slot and to adjust to T-slots of various sizes. The combination of the respective longitudinally extending steps 54 and 64 on one side and a respective longitudinally extending 45 degree angle surface 56 and 66 on the other side lock the base 30 securely to T-slots of various sizes when the nut 20 is tightened. The steps 54 and 64 step away (upwardly with the longitudinal surface facing down) and outwardly from the respective longitudinal surface 52 or 62. On the opposite side of the respective surface 52 or 62 and opposite the respective steps 52 or 62, the ramped surface 56 or 66 angles outwardly away from the respective longitudinal surface 52 or 62. This allows the base 30 to fit securely into many different T-slot tracks.

FIG. 6 is an end view of the base extrusion 30 for the stop assembly 68 fitted into two different tracks. The base 30 has two protrusions 52 and 62 on opposite sides which extend longitudinally along the length of the base and fit into the T-slot of a track to help guide the base and prevent it from rotating relative to the track. The narrow side 52 of base 30 is shown in contact with a T-slot extrusion 152 which is designed to take the head of a ¼-20 bolt. The wide side 62 of base 30 is shown in contact with a T-slot extrusion 84 which is designed to take the head of a 5⁄16 inch bolt.

The steps 64 on the wide side of the base 64 contact the corner of the T-slot 108. The 45 degree angle surface 66 contacts the corner of the opposite side of the T-slot extrusion 108. As the knob 20 is tightened pressure is applied against the step 64 by the 45 degree angle 66 which wedges the base 30 into the T-slot 112 with full contact between the step 64 and the T-slot extrusion 108. The hole in the base 170 through which the bolt 34 extends is oversized, which allows the base 30 to rotate slightly so that the pressure wedges the base 30 into the T-slots of various sizes. The steps 54 and associated ramped surface 56 work the same way, but are more closely spaced to fit into narrower slots.

FIG. 7 is an end view of a track extrusion 110 which is an improvement to the track of U.S. Pat. No. 5,337,641. This figure also shows how the stop base extrusion 30 engages with the new track. The extrusion 110 has a number of advantages over the track of U.S. Pat. No. 5,337,641. There is room for two types of rulers. A 0.530" indentation 118 in the front of the extrusion 110 allows a stick-on-tape to be used on the front of the extrusion. This is useful on a miter saw or radial arm saw for cutting material at a 90 degree angle. A second slot 113 (FIGS. 7 and 10A) is provided on the front, top of the track 110 which includes two opposed grooves 116 which slidably accept a 0.500" tape 114 such as a plastic tape or a replacement tape that is readily available from a local hardware store. The replacement tape 114 can be slid longitudinally in the slot 113 to measure angled cuts, which is useful on a miter saw or radial arm saw for cutting material at an angle other than 90 degrees. This extrusion 110 is called the "half track" because it functions like the top half of track 46 of U.S. Pat. No. 5,768,966. A V groove 132 in the extrusion 110 makes it easier to drill a hole for mounting the half track extrusion 110 to the edge face of a board (so the drill point doesn't hunt away from the centerline of the slot when starting the hole). In addition, the track 110 is ¾" in height (measured at the front, which is convenient since many boards are ¾" thick, so the track can be mounted at the edge of the board and its top surface will be flush with the top surface of the board. In addition, the base 30 can be mounted in either of the two slots 112, 113, since it is highly adaptable as described above.

FIG. 8 is the end view of a track extrusion 148 called the "full track". This figure also shows how the stop base extrusion 30 engages with the track 148. The track 148 has the advantage of mounting directly to a table top for use on a miter saw, mortiser, or a radial drill press. It would also be very handy for quickly making jigs or fixtures. Like the half track 110, there is room for two types of rulers. Also like the half track 110, a V groove 132 in the extrusion 148 makes it easier to drill a hole for mounting the full track extrusion 110 to the face of a board, and also a V groove 132A is provided at the foot of the track 148 to make it easier to drill a hole for mounting the full track extrusion to a board. The full track extrusion 148 is easier to mount to a table or jig board than the track 46 of U.S. Pat. No. 5,768,966 because it can be screwed directly to the surface, by drilling holes in it using the groove 132A. A V groove 146 on the face of the track 148 receives the point 38 of the stop arm 10, to permit the point 38 to penetrate the plane of the fence surface 147. Because the full track 148 weighs less than the track 46 of U.S. Pat. No. 5,768,966, it is less expensive.

Figure 9A:
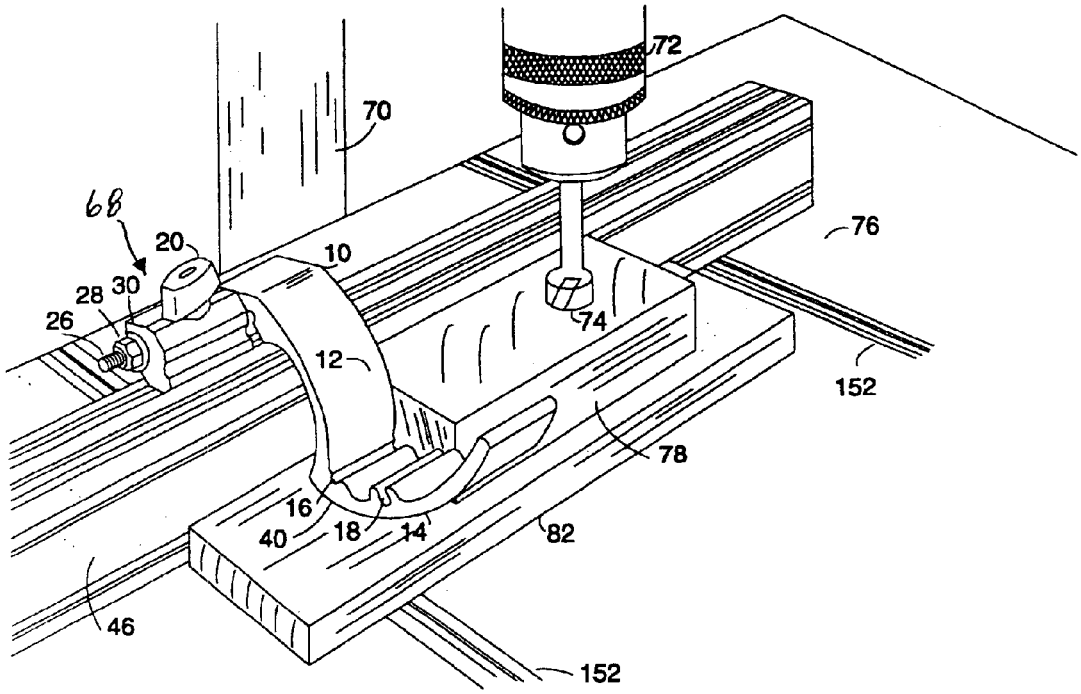
FIG. 9A is a perspective view of a system of the invention applied to a drill press auxiliary table, which shows a movable backer board under the stop.
Figure 9B:
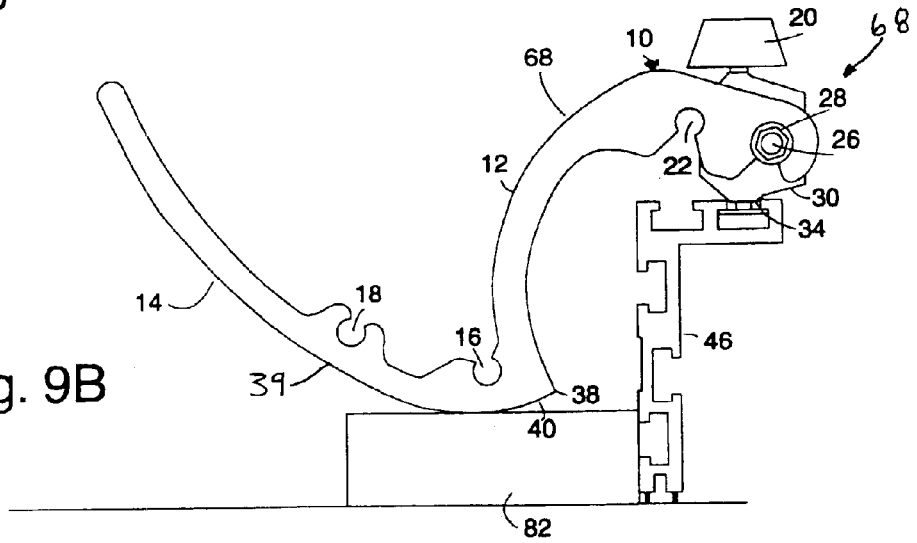
FIG. 9B is an end view of the system of FIG. 9A.

FIGS. 9A and 9B shows the invention as it is used on the drill press. The drill press is used to drill holes, make mortises and rotate sanding drums. The chuck 72 of the drill press holds the drill bit 74 which is advanced into the workpiece to create a hole. The post 70 supports the top of the drill press and the table which supports the workpiece. Because the standard table is quite small a larger auxiliary plywood table 76 is usually added to support larger workpieces. A straight board or straight edge is often clamped to the workpiece to support the workpiece and to prevent it from rotating. The straight edge helps to make multiple holes the same distance from the edge of the board and for a router bit cuts parallel to the edge of a board such as a mortise.

The track 46 (FIGS. 9A and 9B) of U.S. Pat. No. 5,768,966 is ideal fence because it can be used to mount jigs, fixtures, clamps and stops such as the stop assembly 68. The fence 46 is mounted on the back to the tracks 152 in the table 152. The flip stop assembly 68 is used to measure the distance between the end of the workpiece and the drill bit 74. For operations such as mortising, two flip stop assemblies 68 are used with the workpiece moving back and forth between the two stops. Multiple flip stop assemblies 68 are used to measure multiple drill holes parallel to the edge of a workpiece.

The flip stop assembly 68 has two openings at the bottom 18 and 16 for jigs or fixtures which would be attached to the stop. For example they could be used to support a drop pin to space equidistant holes.

Often it is required that the hole be drilled through the workpiece. To prevent tearout as the drill bit 74 exits the back of the workpiece 78 it is standard procedure to position a waste scrap which is called a backer board 82 under the workpiece 78. Because of the unique design of the stop arm 10 the bottom curve 40 rests on the backer board 82. This arrangement allows the stop assembly 68 to accurately measure the distance between the end of the workpiece 78 and the drill bit 74 and allows the backer board 82 to be moved after each hole is drilled which helps to eliminate tearout as the drill bit 74 exits the workpiece 78.

FIG. 9B is an end elevation of the flip stop assembly 68 attached to the L shaped track 46 with the curved flip stop arm 10 resting on top of the backer board 82. The flattened bottom surface 40 of the curved flip stop arm 10 contacts the backer board 82 to reduce the lifting of the arm 10 away from the fence 46.

Figure 10B:
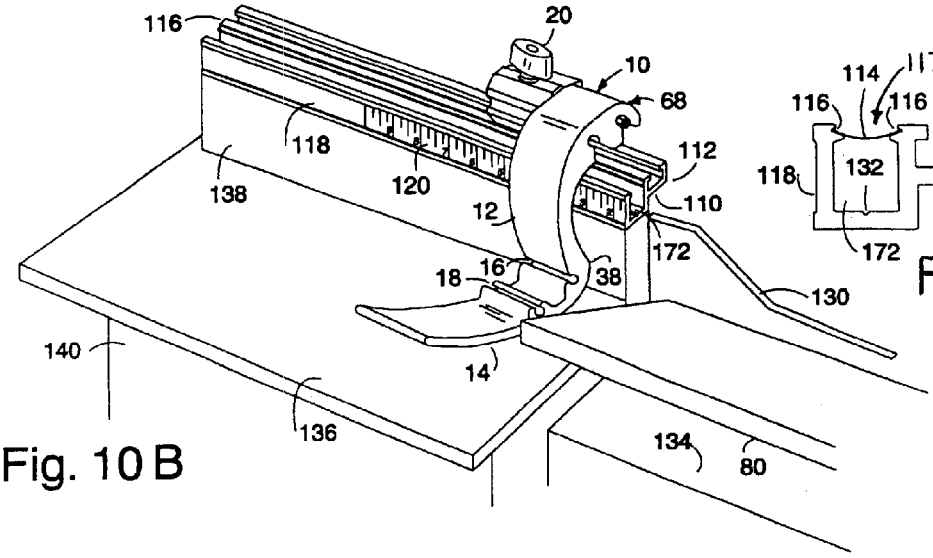
FIG. 10B is a perspective view of a system of the invention applied to a miter saw auxiliary table, which shows a piece of the two slot track (FIG. 7) mounted to the top edge of the fence.

FIG. 10B is a perspective drawing of the curved stop assembly 68 and track 110 as it is used on a miter saw. The workpiece with a mitered end 80 rests on the miter saw table 134 with one edge against the miter saw fence 130. A wood shop made extension table 136 is the same height as the miter saw table 134 so the work piece 80 lays flat on both tables. The extension table 136 is supported by two legs 140. A wood auxiliary fence 138 is mounted on the back of the wood shop made extension table 136. A section of half track 110 with front T-slot 112 is screwed to the upper edge of the wood auxiliary fence 138. The curved flip stop assembly 68 is attached to the T-slot 112 with a bolt 34 which is locked in place by the knob 20.

The bottom curve 14 of the curved flip stop arm 10 is wide enough (front to back) to engage the end of a mitered board 80 that is ¾" by 2¼" with the point of the miter opposite the fence 138. Positioning the point of the miter away from the fence is ideal because the force of the blade cutting the miter on the opposite end applies a consistent pressure against the stop, guaranteeing that all of the workpieces will be cut at a uniform length. If the piece to be mitered is wider than 2¼", an extension can be attached to the curved stop arm 10 by using the hole openings 16 and 18.

Figure 11:
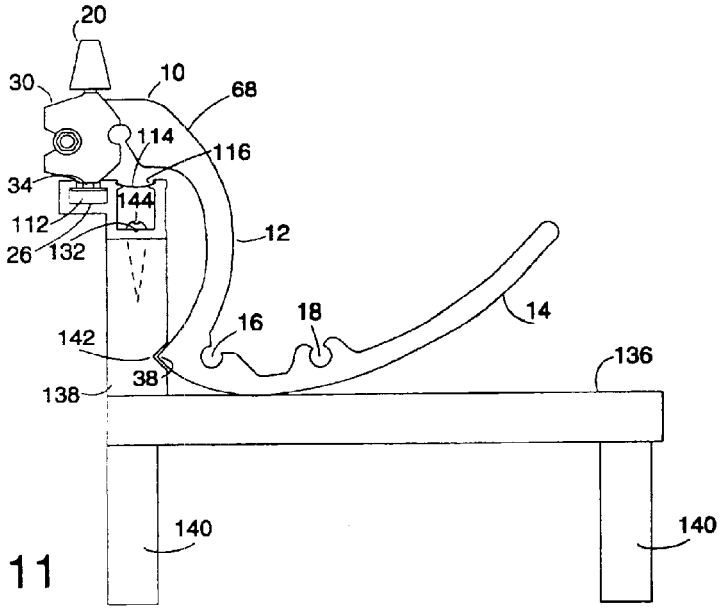
FIG. 11 is an end elevation view of the system of FIG. 10B.

FIG. 11 is an end view of FIG. 10B. A V-groove 142 in the wood miter saw auxiliary fence 138 receives the point 38 of the curved stop arm 10. This mechanism allows the point of a mitered board to rest against the fence 138 without lifting the stop arm 10.

Figure 10A:
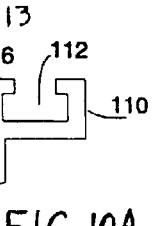
FIG. 10A is an end view of the two slot track with a measurement tape installed.
Figure 12:
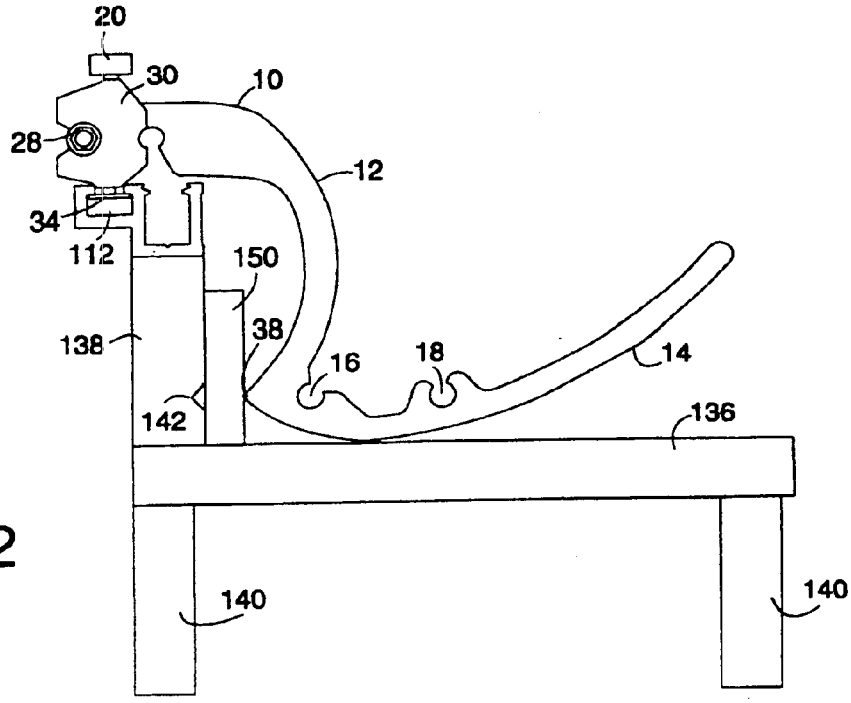
FIG. 12 is an end elevation of the system of FIG. 10B with a zero clearance backer board between the fence and the back point of the stop.

FIG. 12 is an end view of FIG. 10A. When cutting small pieces on a miter saw it is a good practice to support the workpiece with a scrap piece of wood behind it which is called a zero-clearance board. A zero-clearance fence board 150 is located between the wood miter saw auxiliary fence 138 and the point 38 of the curved stop arm 10. It fits into the space created by the top curve of the flip arm 12. This design allows the zero-clearance board 150 to be moved yet the stop arm 10 remains in the same place to accurately measure the rest of the pieces to be cut. The zero-clearance board 150 is especially useful when there is a wide opening between the fences on a miter saw because it prevents small pieces from flying after the piece is cut.

Figure 13:
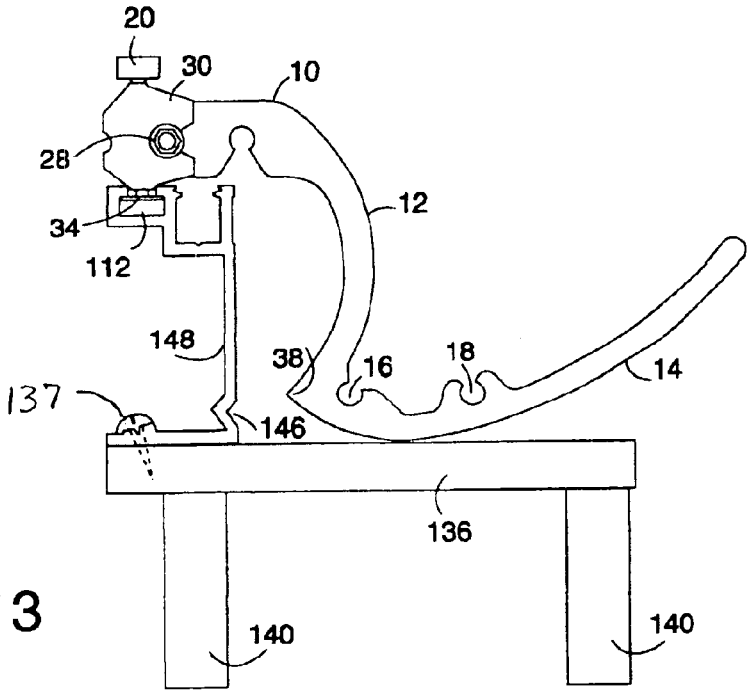
FIG. 13 is an end elevation of the system shown with the modified two slot track (FIG. 8). The base has been reversed from the position of FIG. 8 and FIG. 12 so that the bolt is toward the front, allowing extra space for a zero clearance board.

FIG. 13 is an end view in which the wood miter saw auxiliary fence 138 has been replaced with a solid aluminum extrusion 148 which is screwed to the auxiliary table top 136 by screws 137. In FIG. 13, the base extrusion 30 has been rotated 180 degrees about the axis of bolt 34 hole 35 (FIG. 4) from the position of FIG. 12 so the rotation point of the flip arm 10 is now 0.750" (¾") forward of the previously shown positions (See FIG. 12). It is offset by ¾" because the axis of the stop mounting hole 36 is offset laterally from the axis of the base mounting hole 35 by ⅜". Many boards which would be used for zero clearance boards are ¾" thick, so this is a useful offset in the base. This allows two locations of the flip arm with the use of one T-slot, and helps the stop arm assembly 68 to adjust to different heights of track and different T-slot positions on the track, and to adjust to a number of different stop systems and T-tracks.

Figure 14:
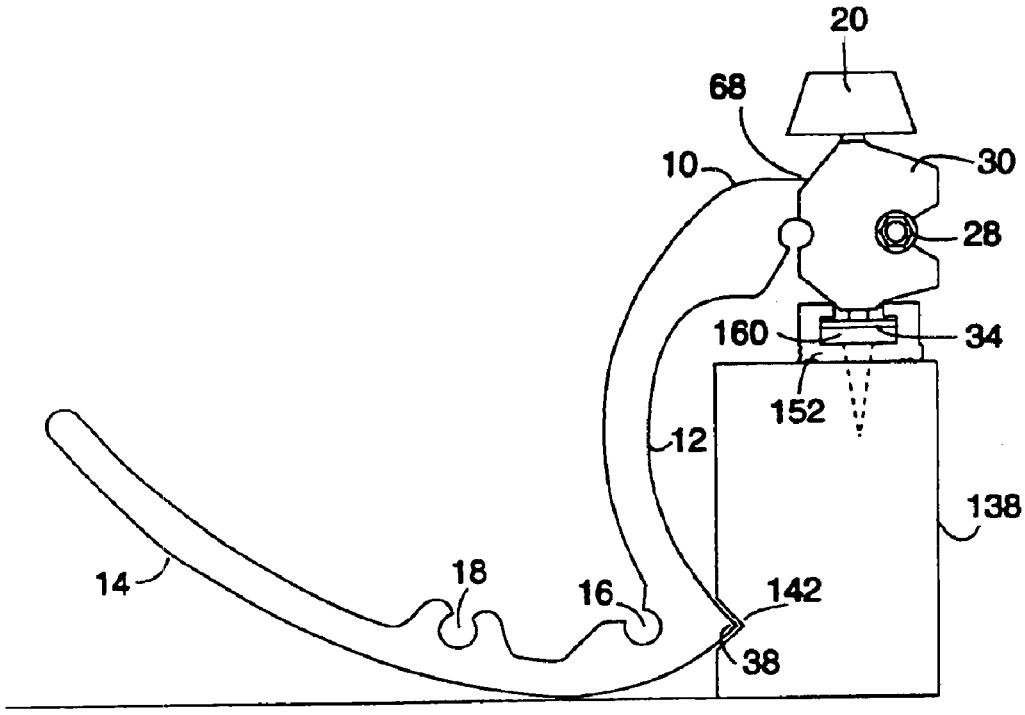
FIG. 14 is an end elevation of the curved stop system mounted on the top side of a fence board with a small T-slot track.

FIG. 14 shows the end view of a stop assembly 68 secured to a small T-slot extrusion 152 which is screwed to a thick auxiliary fence 138. The bolt 34 which connects the stop assembly 68 is captured in the T-slot 160 of the track 152. A V-groove 142 in the fence accepts the point 38 of the flip arm 10. The small T track 152 is inexpensive because it is lightweight and extrusions are bought by the pound. It is particularly useful for jigs and fixtures.

Figure 15:
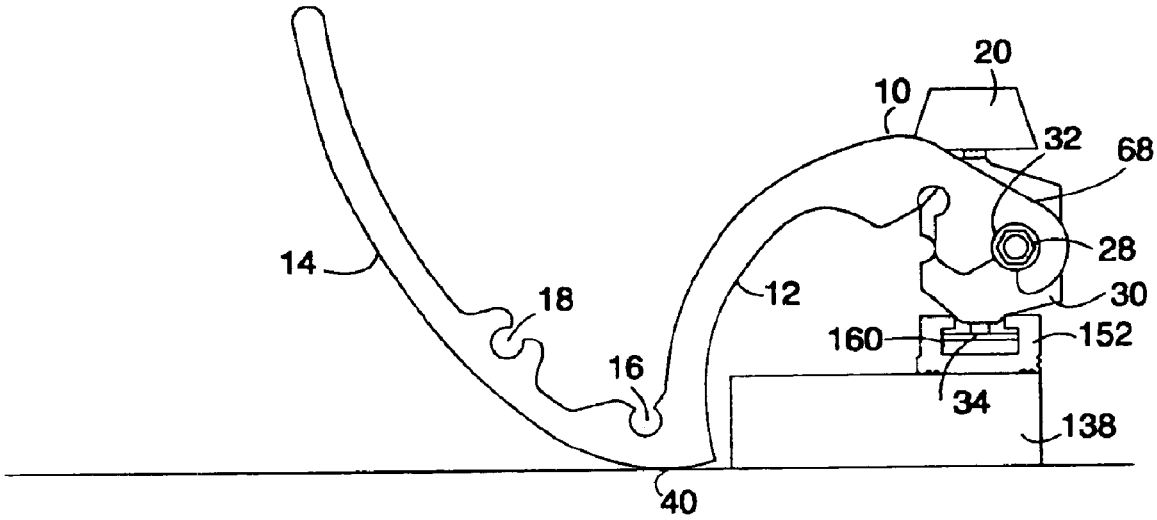
FIG. 15 is an end elevation of the curved stop system mounted on the top side of a much shorter fence board with a small T-slot track, illustrating how the stop adapts to fences of different heights.

FIG. 15 shows the end view of a stop assembly 68 secured to a small T-slot track 152 which is screwed to thin auxiliary fence 138. This illustration shows that the curved top leg 12 of the flip arm 10 allows the arm 10 to adapt to allow the stop assembly 68 to easily adjust to tracks of different heights.

Figure 16:
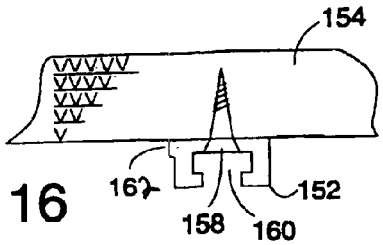
FIG. 16 is an end elevation of the small T-slot track mounted on the bottom of a jig or fixture board.

FIG. 16 shows an end view of the ⅜" by ¾" extrusion 152 screwed to the bottom of a plywood jig board 154 with screws 158 (only one shown). The total width of the extrusion is 0.755". The body of the extrusion is 0.730" wide (not including flange 162) and a 0.125" by 0.025" flange 162 is formed on the side of the body, which increases the total width of the track to 0.755".

Figure 17:
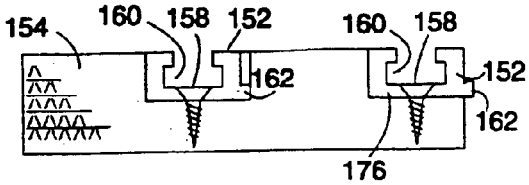
FIG. 17 is an end elevation of the small T-slot track mounted in a dado and one mounted in a groove of a jig or fixture board.

FIG. 17 shows an end view of the T-slot extrusion 152 screwed to the plywood jig board 154 with screws 158 (only one shown). The T-slot extrusion 152 is located inside a dado 174 and a rabbet 176. Corrugations 156 (See detail in FIGS. 18 and 19) on the corners of the T-slot extrusion 152 and the flange 162 allow the extrusion to be glued into a dado 174 or a rabbet 176 as is shown in FIG. 17.

Figure 18:
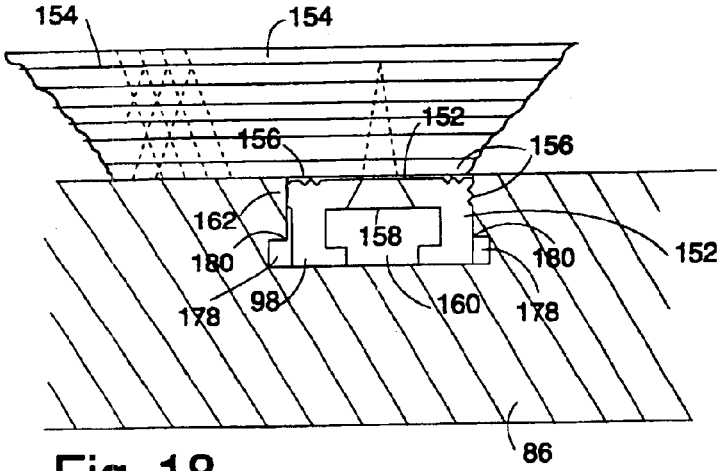
FIG. 18 is an end elevation of the small T-slot track mounted on the bottom of a jig or fixture board with the track riding in a tablesaw miter slot.

FIG. 18 shows an enlarged end view of the T-slot extrusion 152 screwed to a plywood jig board 154 with screws 158 (only one shown). The T-slot extrusion 152 is located inside the tablesaw miter slot 98. The 0.125" by 0.025" flange 162 contacts the side of the table saw miter slot 98 on the left side and the opposite side of the track 152 contacts the T-slot on the right as shown in FIG. 18.

Figure 19:
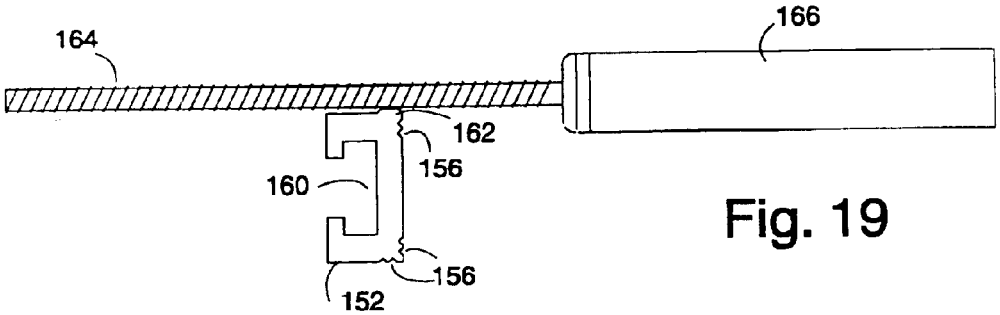
FIG. 19 is an end elevation of the small T-slot track with the flange being filed to decrease the width of the track.

FIG. 19 shows an enlarged end view of the T-slot extrusion 152. For a jig or fixture bar to accurately fit the tablesaw miter slot 98, the width of the T-slot extrusion 152 must be adjusted to the individual saw. Saw manufacturers' miter slots 98 vary in size, typically about 0.745 to about 0.738".

U.S. Pat. No. 5,617,909 provides a mechanism for adjusting a solid bar. U.S. Pat. No. 5,275,074 describes a bar which is designed to function as a miter slot bar for jigs and fixtures. The '074 bar expands equally in two places on the bar. If the jig is retracted and one of the expansion areas on the bar is pulled forward out of the miter slots 98 the fit is very sloppy because it is only being tightened at one point. The '074 bar works best if the miter slot 98 has square bottom corners which is common on older saws because the bar expands at the bottom and not the top. If the saw is newer and has the washer slots 178 at the bottom of the miter slots 98, the expansion areas of the I'074 bar can still contact the top corner 180 of the washer slots 178. The top corner 180 of the washer slots 178 is sharp and digs into the soft aluminum of the two expansion areas on the '074 bar, compromising the fit.

The jig and fixture bar 152 of the invention is an improvement over the other bar systems because it maintains full length contact between the bar 152 and the miter slot 98. The 0.125" by 0.025" flange 162 contacts the top of the side of the tablesaw miter slot 98. The extrusion 152 can be adjusted in width by filing the flange 162. The extrusion 152 is secured and the file 164 and the file handle 166 are kept parallel to the extrusion as a single full length pass is made to remove material from the flange 162. A single full length pass with a fine file will remove about 0.001" of material from the flange 162. Test fitting after filing allows a very good fit between the extrusion 152 and the miter slot 98. Because there is full length contact between the extrusion 152 and the miter slot 98, the fit remains good even if the jig or fixture is retracted and part of the extrusion is extending out of the end of the slot.

Figure 20:
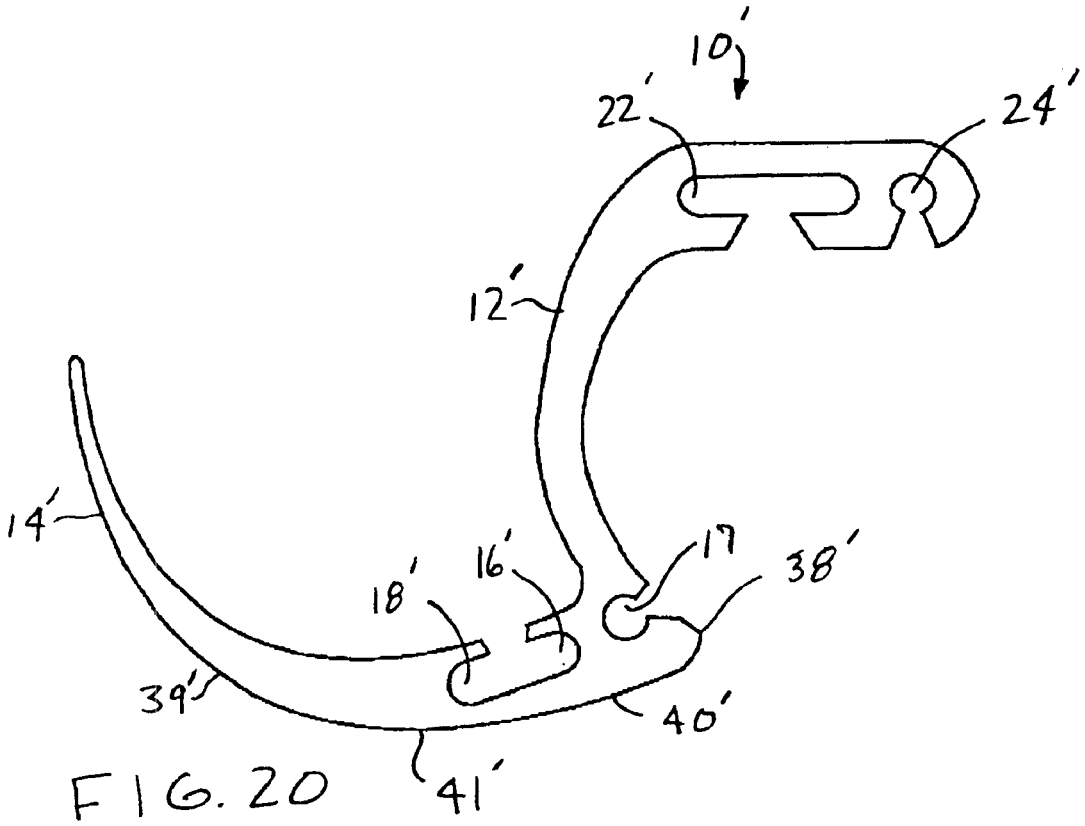
FIG. 20 is a side elevation view of a modified flip stop arm of the invention.

FIG. 20 illustrates a modified curved flip stop 10' which is very similar to the flip stop 10. Similar features and elements are identified with the same reference number, plus a prime (') sign.

In FIG. 20, the leg 14' is somewhat shorter than leg 14 and so it curves upwardly toward its free end with a smaller radius. The point of inflection 41' at which the curvature of the lower surface of leg 14' changes is not defined by a definite point but rather a change in slope from positive to negative, i.e., on both sides of the inflection point 41', the bottom surface of leg 14 slopes upwardly toward the adjacent end.

The holes 18' and 16' are integrated into one elongated hole which has an open slot on its upper side, which is wide enough so that a ¼'" bolt may be placed through it (parallel to it) so the bolt doesn't have to be inserted through the end of the hole. Another open side hole 17 is also extruded into the track 10' to permit additional accessory mounting options. Projecting portion 38' is provide on the rear side of the leg 14' where the lower surface of the leg 14' joins with the rear surface of the leg 12' which, as in the leg 10, is concave toward the working plane of the fence or other woodworking support. The hole 22' at the top of the leg 12' is also made as an elongated hole to provide additional accessory mounting options, this elongated hole having the open slot on the bottom side. Hole 24' is provided on the top, rear end of the top leg 12' in a manner similar to the hole 24 in stop 10.

The invention provides an improved system for making jigs, fixtures, and machine accessories in a woodworking shop, and which can be used to enhance wood and metal fences and wood tables of woodworking machines such as a table saw, band saw, miter saw, radial arm saw, drill press, and router tables. In a woodworking machinery jig and fixture system of the invention, a section of track has a T-slot guide for releasably mounting accessories to the track. The accessories are slidable longitudinally along the guide and the track can be fixed to the edge of a separate woodworking support, or it may itself provide a fence or other woodworking support.

In another aspect, the back of the curved flip stop arm forms a point which penetrates the front plane of the fence. The point where the curved surfaces meet is designed to fit into the bottom T-slot of the extrusion fence 200 from U.S. Pat. No. 5,768,966. This allows the point of the miter to rest against the fence and not lift up the stop, because the point of the miter contacts the side face of the curved flip stop. By making a simple cut or groove in the wood fence of a radial or miter saw the point of the curved flip stop can be made to enter the groove and thereby penetrate the working plane of the fence, preventing the point of a miter from lifting the flip stop.

A curve at the back of the top leg 14, 14' of the arm 10, 10' also provides space for a zero clearance board to be placed between the fence and the stop on a radial or miter saw, and still permit the stop to be swung into a work position.

In another aspect of the invention, the curved flip stop 10, 10' is mounted to the base 30 to pivot between a work position for engaging a workpiece placed against a woodworking support to position the workpiece relative to the woodworking tool and a standby position out of engagement with the workpiece. The curved arm of the flip stop allows a board to be shoved underneath it, which elevates it allowing the standby position to be achieved without manually lifting the stop arm out of the way. The curved stop arm rests on top of the workpiece until the workpiece is moved, and then it falls into the engaged position.

The tip, or toe end, of the flip arm is located about 2¼" above the surface of the table, which allows 1½" construction material to easily raise the flip arm. The distance between the point 38, 38' that penetrates the plane of the fence and the tip of the flip stop arm is 4⅞". This flip stop arm width allows a mitered board 2½" wide to be cut with the point away from the fence and remain in contact with the flip arm. Two openings 22, 22' and 24, 24' on the top of the curved fence extrusion allow auxiliary wood fences to be attached to the curved flip arm 10, 10'.

In another aspect, a secondary curve 40, 40' on the back, or heel end, of the bottom curve of the flip stop 10, 10' provides contact with the surface of a jig, fixture, or a table, no matter the height of the fence, within reasonable limits. This secondary curve design is particularly useful on a drill press because the stop can rest on top of a moveable backer board. The stop can maintain the distance between the end of the board and the drill bit while the backer board is moved slightly to provide a new surface under the workpiece which provides a clean exit hole for the drill bit.

A second hole 22, 22' at the front of the flip arm is designed so that it functions with the base number 24 of U.S. Pat. No. 5,337,641. This provides for the curved flip arm 10, 10' to be locked against the base 30 (with the bolt shank in the half hole 60 of the base 30) and for the use of the microadjuster from U.S. Pat. No. 5,337,641.

In another aspect, the base 30 is mounted to the track and is slidable longitudinally relative to the track and securable at multiple alternative positions along the track. The base 30 is adjustable to various widths of track by means of a series of steps 54 or 64 which contact one side of the T-slot and a 45 degree ramped surface 56 or 66 which angles on the opposite side of the base and contacts the other side of the T-slot. The base is secured without rotating in the track. The base is reversible. Although both sides of the base have steps and an opposing 45 degree angle ramp, the distance between the steps and the ramp is different on each side, allowing the base to fit tracks of different sized T-slots.

In another useful aspect, an L-shaped track 110 is designed to attach to the edge of a fence. This is an improvement over the design of track 34 in U.S. Pat. No. 5,337,641. This design is especially useful for the radial or miter saw. This L-shaped track accommodates both a fixed stick on tape and a slidable tape which is the standard half inch replacement tape found in local hardware stores. This track extrusion is easily screwed to the edge of a board or to a flat surface for a jig or a fixture.

In another aspect, a light weight track 152 that is easily cut and that can be attached to the face or edge of a board or that could be housed in a dado or a rabbet or a miter slot is provided. The track is secured to wood with drywall screws and is bolted to machinery or jigs and/or fixtures with standard ¼" bolts. Grooves on the corners of the track provide a surface for gluing the track in a dado in a wood or manmade board material. A groove protrudes on one corner that is ⅛" wide that can easily be filed to fit the track accurately into a miter slot on a table saw, shaper, band saw, router table, or other woodworking machine. The track is designed so that all fixture and components are secured to it with a quarter inch bolt. Thereby, the system is readily adaptable to many applications and woodworking machines.

Preferred embodiments of the invention have been described in considerable detail. Many modifications and variations to the preferred embodiments will be apparent to persons of skill in the art, which will be within the spirit and scope of the invention. Therefore, the invention should not be limited to the preferred embodiments described, but should be defined by the claims which follow.

I claim:

1. In a woodworking machinery jig and fixture system having a woodworking support which defines a working plane and a stop for guiding a workpiece supported by the woodworking support to position said workpiece relative to a woodworking tool, the improvement wherein said stop has a projecting portion on a rear face of said stop facing said woodworking support and said woodworking support has a recess which opens to said working plane, said recess being positioned so as to receive said projecting portion in a work position of said stop so that said projecting portion penetrates said working plane of said woodworking support in said work position; and wherein said stop is pivotable about a longitudinal axis and is generally L-shaped, having a top leg and a bottom leg connected to a lower end of the top leg, said bottom leg extending from the top leg away from the woodworking support and having a lower surface which is convex toward a work surface on which a workpiece can be supported, said lower surface curving such that when said stop is in the work position said lower surface is closest to said work surface at a point which is between ends of said surface.

2. In a flip stop for a woodworking machinery jig and fixture system having a woodworking support which defines a working plane, the flip stop being generally L-shaped and pivotally mounted to the woodworking support for guiding a workpiece supported by the woodworking support to position the workpiece relative to a woodworking tool, the L-shaped flip stop having a top leg with a rear surface that faces the woodworking support and a bottom leg connected to a lower end of the top leg and extending from the top leg away from the woodworking support, the improvement wherein:

the rear surface of the top leg is concave toward the woodworking support;

the bottom leg has a lower surface which is convex toward a work surface on which a workpiece can be supported; and the lower surface of the bottom leg curves such that when the stop is in the work position the lower surface is closest to the work surface at a point which is between ends of the lower surface.

3. A woodworking machinery jig and fixture system as claimed in claim 2 wherein the stop has a projecting portion which penetrates the working plane of the woodworking support in a work position of the stop.

4. In a flip stop for a woodworking machinery jig and fixture system having a woodworking support which defines a working plane, the flip stop being generally L-shaped and pivotally mounted to the woodworking support for guiding a workpiece supported by the woodworking support to position the workpiece relative to a woodworking tool, the L-shaped flip stop having a top leg with a rear surface that faces the woodworking support and a bottom leg connected to a lower end of the top leg and extending from the top leg away from the woodworking support, the improvement wherein the bottom leg has a lower surface which is convex toward a work surface on which a workpiece can be supported and the lower surface of the bottom leg curves such that when the stop is in the work position the lower surface is closest to the work surface at a point which is between ends of the lower surface.

5. A woodworking machinery jig and fixture system as claimed in claim 4, wherein the stop has a projecting portion which penetrates the working plane of the woodworking support in a work position of the stop.

6. A woodworking machinery jig and fixture system as claimed in claim 4, wherein the rear surface of the top leg is concave toward the woodworking support.

7. In a base for a woodworking machinery jig and fixture system having a track and a stop mounted to the track by the base, which is slidable in a slot of the track, said base being secured in said slot with a fastener which extends through a hole in said base, the improvement to said base wherein said hole extends through opposed longitudinal surfaces of said base, one said longitudinal surface on each side of said base, wherein each of said longitudinal surfaces may be received in a slot of a track and wherein said surfaces are different in width to fit different width slots.

8. A base as claimed in claim 7, wherein a surface of said base adjacent at least one of said longitudinal surfaces includes longitudinally extending steps leading to said surface.

9. A base as claimed in claim 8, wherein said base includes a longitudinally extending ramped surface angling outwardly from said at least one longitudinal surface on a side of said longitudinal surface which is opposite from said steps.

10. A base as claimed in claim 7, wherein adjacent to each said longitudinal surface said base defines at least one longitudinally extending step extending away and outwardly from said longitudinal surface on a side of said longitudinal surface, and on the other side of each said longitudinal surface, said base defines a ramped surface angling outwardly away from each said longitudinal surface.

11. In a base for a woodworking machinery jig and fixture system having a track and a stop mounted to the track by a base which is slidable in a slot of the track, said base being secured in said slot with a fastener which extends through a hole in said base, the improvement to said base wherein said hole extends through at least one longitudinal surface of said base and said base defines longitudinal steps on one side of said surface which step away and outwardly from said surface.

12. A base as claimed in claim 11, wherein at a side of said longitudinal surface which is opposite from said steps, said base defines a ramped surface opposite said steps which angles outwardly away from the longitudinal surface.

* * * * *